United States Patent [19]

Bayless

[11] 3,978,363

[45] Aug. 31, 1976

[54] HIGH-VOLTAGE MECHANICAL SUPPORT FOR GAS DISCHARGE DEVICE

[75] Inventor: John R. Bayless, Malibu, Calif.

[73] Assignee: Hughes Aircraft Company, Culver City, Calif.

[22] Filed: July 22, 1975

[21] Appl. No.: 601,101

[52] U.S. Cl. ..... 313/289; 313/256; 313/285; 313/335

[51] Int. Cl.[2] ..... H01J 1/96; H01J 19/50

[58] Field of Search ..... 313/256, 284, 285, 286, 313/289, 335; 333/79, 97 C

[56] References Cited

UNITED STATES PATENTS 2,736,816 2/1956 Morley ..... 313/256 X 3,334,260 8/1967 Youdin ..... 313/284 X

*Primary Examiner*—Saxfield Chatmon, Jr.

*Attorney, Agent, or Firm*—Allen A. Dicke; William H. MacAllister

[57] ABSTRACT

Ceramic support is mounted between the housing and an electrode to physically support the electrode with respect to the housing. Mechanical support is provided in an environment of high electrical potential in a gaseous environment where Paschen breakdown, vacuum breakdown and surface breakdown are significant failure modes which result in electric conduction between the housing and electrode.

7 Claims, 2 Drawing Figures

HIGH-VOLTAGE MECHANICAL SUPPORT FOR GAS DISCHARGE DEVICE

The invention described herein was made in the course of or under a contract with the Department of the Navy, Office of Naval Research.

BACKGROUND

This invention is directed to a mechanical support for a gas discharge device wherein the mechanical support supports an electrode with respect to a housing with a substantial voltage difference thereacross.

Prior to the development of the present mechanical support, the support in such devices as the crossed-field tube, see U.S. Pat. Nos. 3,641,384, and 3,678,289, as well as plasma cathode electron guns, see U.S. Pat. No. 3,831,052, was provided solely by the electrical feedthrough. This feedthrough was generally a relatively large component which incorporated a ceramic assembly as the mechanical support and electrical insulator. Additional mechanical support for an electrode with respect to a housing is often advantageous. In the case of the crossed-field tube, the feedthrough ceramic size and the close tolerance requirements can be reduced through use of a second simple support, as described in this specification. Such a support serves to aid in the support and location of the anode with respect to the cathode. In the case of the plasma cathode electron gun, mechanical support is required at each end of the cathode cylinder, when the structure is of substantial length. The present drawings show this invention in that environment.

A certain amount of study on the problem of the juncture between a ceramic insulator post and an electrode was done by Schoenhuber and published in IEEE Transactions on Power Apparatus and Systems, Vol. 88, page 100, in 1969.

SUMMARY

In order to aid in the understanding of this invention it can be stated in essentially summary form that this invention is directed to a high voltage mechanical support for a gas discharge device, and particularly a ceramic post which locates and supports an electrode with respect to a housing so that high voltage stand-off can be achieved with a gas in the space between the electrode and the housing.

It is thus an object of this invention to design a mechanical support to support an electrode, with a high electric field across the support. It is a further object to provide a mechanical supporting structure which is capable of withstanding a high electric field in the presence of a gas, with the conditions avoiding Paschen discharge, vacuum breakdown and surface breakdown. It is another object of this invention to provide an economic structure which is convenient to use and is reliable under the adverse electric field and other conditions to which it is subjected.

Other objects and advantages of this invention will become apparent from a study of the following portion of the specification, the claims and the attached drawings.

DESCRIPTION OF THE PREFERRED EMBODIMENT

Figure 1:
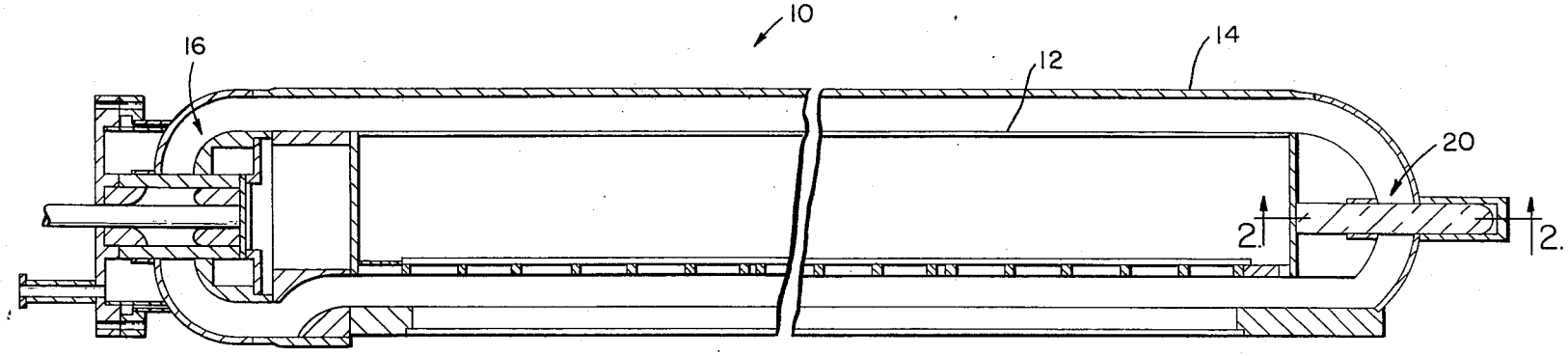
FIG. 1 is a longitudinal section through a plasma cathode electron gun incorporating the high-voltage mechanical support of this invention.

The plasma cathode electron gun 10 illustrated in FIG. 1 has cathode 12 supported in housing 14. The details of the plasma cathode electron gun are shown in more detail in Ronald Knechtli U.S. Pat. No. 3,831,052. The left end of the electron gun 10, as seen in FIG. 1, has a combined high-voltage feedthrough and mechanical support 16. That structure is shown in more detail in John R. Bayless Patent Application Ser. No. 553,875, filed Mar. 3, 1975. When the electron gun is long, as shown in FIG. 1, a support at the other end of cathode 12 is helpful.

Figure 2:
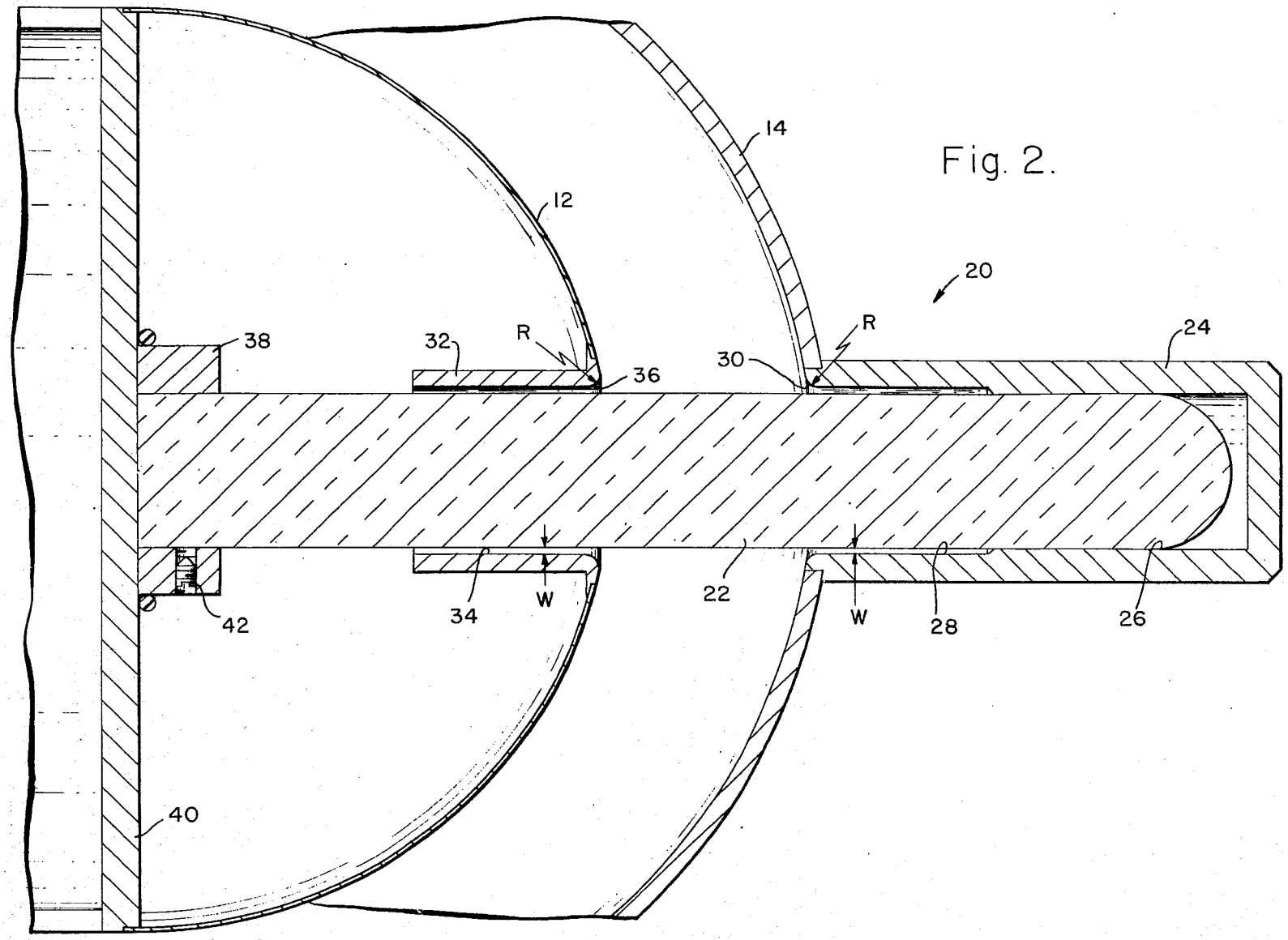
FIG. 2 is an enlarged section of a portion of the plasma cathode electron gun showing the high-voltage mechanical support of this invention in greater detail.

Support 20 of this invention meets the critical requirements. Post 22, as shown in FIG. 2, serves as the interconnecting structural member. It is a ceramic post, formed of AL–300 alumina, or the like. Socket 24 is secured to housing 14 to form bore 26 in which the end of post 22 is closely seated. The fit is a close clearance fit in order to permit easy disassembly. Socket 24 is of larger diameter in a portion of its length toward housing 14, so that relief 28 is spaced a distance W from the post. Relief 28 joins the inner surface of housing 14 at radius 30, having radius R. Thus, post 22 is firmly mounted with respect to housing 14. Socket 32 is secured to cathode 12 to extend away from the inner electrode space and receive post 22. Relief bore 34 of socket 32 is larger than the diameter of cylindrical ceramic post 22 to provide a space W therebetween. Relief bore 34 joins the outer surface of cathode 12 with radius 36 of dimension R. Holder 38 is secured below socket 32 on base plate 40 which is fastened in electrode 12. Post 22 is secured in holder 38 by set screw 42 to hold the structure together.

In a specific example, with an interelectrode distance *d* of 4 cm, and the helium fill of 0–50 milliTorr therein, the support can withstand 200 kV without vacuum, surface, bulk or Paschen breakdown. In such a structure, the radial space W is 2 mm, the radium R is 5 mm, and the diameter of post 22 is 3.3 cm. In the structure, the length of the relief bores 28 and 34 is 3.4 cm and the length in which post 22 fits closely within its socket bore 26 is 5 cm.

The preparation of the ceramic is very important when the support post 22 is used in the plasma cathode electron gun. Without proper cleaning, it was observed that the high-voltage standoff capability was degraded, and tracks were noted on the ceramic post. In this case, fine ceramic dust was present on the electrodes near support 22. In order to eliminate the possibility of the presence of ceramic particles which reduce the voltage holdoff capability, the following cleaning method or one similar to it is considered to be part of the invention to provide the maximized voltage holdoff. Post 22 was formed and cleaned by grinding it to diameter and cutting it to length, followed by cleaning by sandblasting and then boiling for a half an hour in an 80% $H_2SO_4$ plus 20% $HNO_3$ solution. After this etching, the post is rinsed in boiling deionized water several times, and then air dryed for one hour at 100°C. This cleaning process more fully removes loose ceramic particles and results in superior insulator performance.

The subject matter of all of the cross-references in this specification is incorporated herein in its entirety by this reference. This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

I claim:

1. A high voltage insulator and mechanical support for a gas discharge device, said discharge device comprising:

an inner electrode having an outer surface and an outer electrode having an inner surface, said surfaces being spaced from each other;

feedthrough means for supporting said inner electrode from said outer electrode and for feeding a voltage to said inner electrode separately from said outer electrode;

a high voltage insulator mechanical support spaced from said feedthrough means, said insulator mechanical support comprising a wall in said inner electrode forming a socket extending inwardly into said inner electrode, a wall in said outer electrode forming a socket extending outwardly from said outer electrode and a ceramic post engaging in said sockets for supporting said inner electrode with respect to said outer electrode, said wall forming said socket in said outer electrode joining the inner surface of said outer electrode with a radius.

2. The device of claim 1 wherein said wall forming said socket in said inner electrode joins the outer surface of said inner electrode with a radius.

3. A high voltage insulator and mechanical support for a gas discharge device, said discharge device comprising:

an inner electrode having an outer surface and an outer electrode having an inner surface, said surfaces being spaced from each other;

feedthrough means for supporting said inner electrode from said outer electrode and for feeding a voltage to said inner electrode separately from said outer electrode;

a high voltage insulator mechanical support spaced from said feedthrough means, said insulator mechanical support comprising a wall in said inner electrode forming a socket extending inwardly into said inner electrode, a wall in said outer electrode forming a socket extending outwardly from said outer electrode and a ceramic post engaging in said sockets for supporting said inner electrode with respect to said outer electrode, said wall forming said socket in said inner electrode joining the outer surface of said inner electrode with a radius.

4. A high voltage insulator and mechanical support for a gas discharge device, said discharge device comprising:

an inner electrode having an outer surface and an outer electrode having an inner surface, said surfaces being spaced from each other;

feedthrough means for supporting said inner electrode from said outer electrode and for feeding a voltage to said inner electrode separately from said outer electrode;

a high voltage insulator mechanical support spaced from said feedthrough means, said insulator mechanical support comprising a wall in said inner electrode forming a socket extending inwardly into said inner electrode, a wall in said outer electrode forming a socket extending outwardly from said outer electrode and a ceramic post engaging in said sockets for supporting said inner electrode with respect to said outer electrode, said wall forming said socket in said outer electrode joining said inner surface of said outer electrode with a radius and said wall forming said socket in said inner electrode joins said outer surface of said inner electrode with a radius, and said socket in said outer electrode having a relief bore therein adjacent said inner surface of said outer electrode, said relief bore being of greater diameter than the diameter of said ceramic post to form a space therebetween and said socket has a bore which is close fitting with said ceramic post spaced beyond said relief bore away from said inner surface of said outer electrode.

5. The device of claim 4 wherein said socket in said inner electrode has a relief bore therein adjacent said outer surface of said inner electrode, said relief bore being of greater diameter than the diameter of said ceramic post to form a space therebetween and said socket has a bore which is close fitting with said ceramic post spaced beyond said relief bore away from said outer surface of said inner electrode.

6. A high voltage insulator and mechanical support for a gas discharge device, said discharge device comprising:

an inner electrode having an outer surface and an outer electrode having an inner surface, said surfaces being spaced from each other;

feedthrough means for supporting said inner electrode from said outer electrode and for feeding a voltage to said inner electrode separately from said outer electrode;

a high voltage insulator mechanical support spaced from said feedthrough means, said insulator mechanical support comprising a wall in said inner electrode forming a socket extending inwardly into said inner electrode, a wall in said outer electrode forming a socket extending outwardly from said outer electrode and a ceramic post engaging in said sockets for supporting said inner electrode with respect to said outer electrode, said ceramic post having a surface which is substantially free of loose ceramic particles.

7. The method of cleaning a high-voltage insulator mechanical support post for a gas discharge device which has an inner electrode and an outer electrode and an inert gas at subatmospheric pressure in the space therebetween, together with a socket in the inner electrode and a socket in the outer electrode for receiving the support post to support the inner electrode with respect to the outer electrode comprising the steps of:

sandblasting the ceramic post;

boiling the ceramic post for at least a half-hour in a sulphuric acid-nitric acid solution;

rinsing the ceramic post in boiling water; and drying the ceramic post at at least substantially 100°C.

* * * * *